US008132275B2

(12) United States Patent
Wilson et al.

(10) Patent No.: US 8,132,275 B2
(45) Date of Patent: Mar. 13, 2012

(54) TUB ENCLOSURE WITH HINGES BETWEEN WALLS

(75) Inventors: David J. Wilson, New Baltimore, MI (US); Evan Carpenter Crawford, Farmington Hills, MI (US); Jeffrey A. DeBoer, Ann Arbor, MI (US)

(73) Assignee: Aqua Glass Corporation, Adamsville, TN (US)

( * ) Notice: Subject to any disclaimer, the term of this patent is extended or adjusted under 35 U.S.C. 154(b) by 1840 days.

(21) Appl. No.: 11/107,422

(22) Filed: Apr. 15, 2005

(65) Prior Publication Data

US 2006/0230515 A1 Oct. 19, 2006

(51) Int. Cl.
*A47K 3/32* (2006.01)

(52) U.S. Cl. ..... 4/600; 4/614

(58) Field of Classification Search ..... 4/538, 584, 4/596, 612, 614; 52/35, 71–72
See application file for complete search history.

(56) References Cited

U.S. PATENT DOCUMENTS 2,885,722 A * 5/1959 Halliday ..... 16/237
3,385,462 A * 5/1968 Deldime et al. ..... 53/447
3,574,869 A * 4/1971 Skyhawk ..... 4/614
3,940,806 A * 3/1976 Mustee ..... 4/614
3,996,705 A * 12/1976 Gutierrez ..... 52/71

* cited by examiner

*Primary Examiner* — Huyen Le
(74) *Attorney, Agent, or Firm* — Carlson, Gaskey & Olds PC

(57) ABSTRACT

The present invention is a tub and shower enclosure formed from three pieces. A wet wall, back wall, and dry wall are each formed separately. Living hinges connects the wet wall to one end of the back wall and the dry wall to the opposing end of the back wall. The hinges allow the wet wall and dry wall to be folded into positions that are generally parallel to the back wall for shipping.

16 Claims, 3 Drawing Sheets

TUB ENCLOSURE WITH HINGES BETWEEN WALLS

BACKGROUND OF THE INVENTION

This invention relates to a tub and shower enclosure, having a living hinge to connect the walls and simplify transportation and installation.

Tub and shower enclosures generally include a wet wall, from which the shower head and faucet extend, a back wall, and a dry wall that opposes the wet wall. The three walls form a u-shaped enclosure. The fourth side is left open for entry and exit into the enclosure. Typically, a shower door or curtain is positioned along the fourth side. If the three walls were made of a single enclosure it would be large and heavy making shipping and installation awkward and difficult.

To make transportation and installation easier the tub and shower enclosures commonly have been made of two or three separate pieces that are assembled together on site. The wet wall and half the back wall may form one piece and the dry wall and other half of the back wall may form a second piece. The pieces are manufactured separately and then assembled within the tub and shower enclosure. Caulk is used to seal the joint between the two pieces. The two piece system is still difficult to package and transport because of the awkward shape. For remodels and reconstructions situation it is difficult to get the pieces through the houses and into the tub area due to their size and shape.

A tub and shower enclosure which is easier to transport and install is needed.

SUMMARY OF THE INVENTION

The present invention provides a tub and shower enclosure that is formed of three pieces where the wet and dry wall may be folded while moving the enclosure to allow for easier handling and packaging. A wet wall, back wall, and dry wall are each formed separately. A first living hinge connects the wet wall to one end of the back wall. A second living hinge connects the dry wall to the opposing end of the back wall.

The hinges allow the wet wall and dry wall to be folded into positions that are generally parallel to the back wall for transport. The folded assembly is the generally flat and can be packaged more easily. In addition, the folded walls make navigation of the assembly through doors and hallways easier for homes where the tub location is difficult to reach. The walls can be unfolded at the installation side and easily mounted.

The living hinge may be formed from a single piece of material. One portion is connected to the back wall and a second portion is connected to the wet or dry wall. The hinge may be connected to the tub enclosure walls by fasteners, glue, or the like. While living hinges are disclosed other hinge types can be utilized.

These and other features of the present invention can be best understood from the following specification and drawings, the following of which is a brief description.

DETAILED DESCRIPTION OF THE PREFERRED EMBODIMENT

Figure 1:
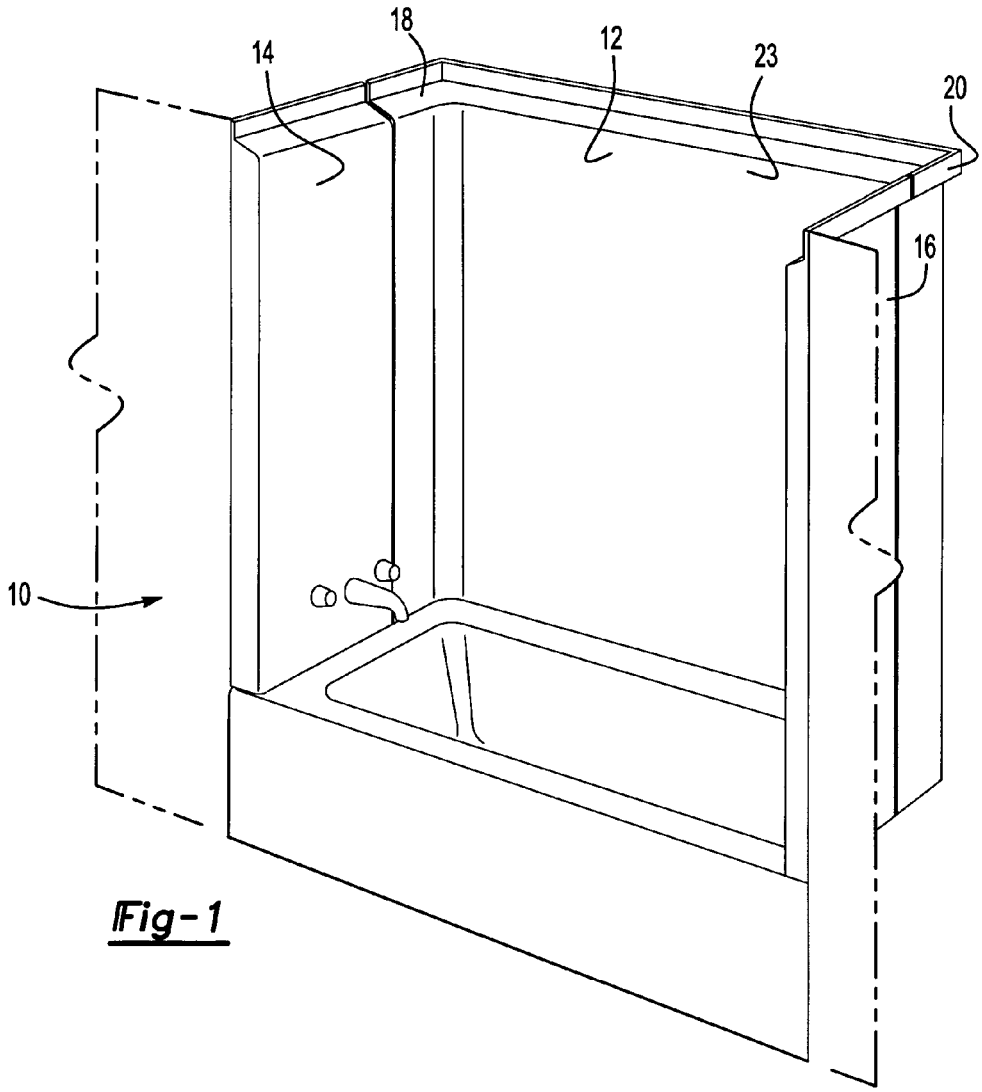
FIG. 1 is a perspective view of the tub and shower enclosure in the installation position.

FIG. 1 is a perspective view of an enclosure 10 for a tub or shower. The enclosure 10 has a back wall 12, a first side wall 14 and a second side wall 16. The first side wall 14 is connected to the back wall 12 at a first end 18. The second side wall 16 is connected to the back wall 12 at a second end 20 opposing the first end 18.

The first side wall 14 is a wet wall. That is, it receives the shower and tub faucet, showerhead, etc. The second side wall 16 is a dry wall, the wall opposing the wet wall in the enclosure 10. Together the three pieces form a U-shaped assembly. The open fourth side of the enclosure 10 is used for entering and exiting the tub and shower enclosure 10. Additionally, the fourth side may accommodate a shower door, or curtain.

Figure 2:
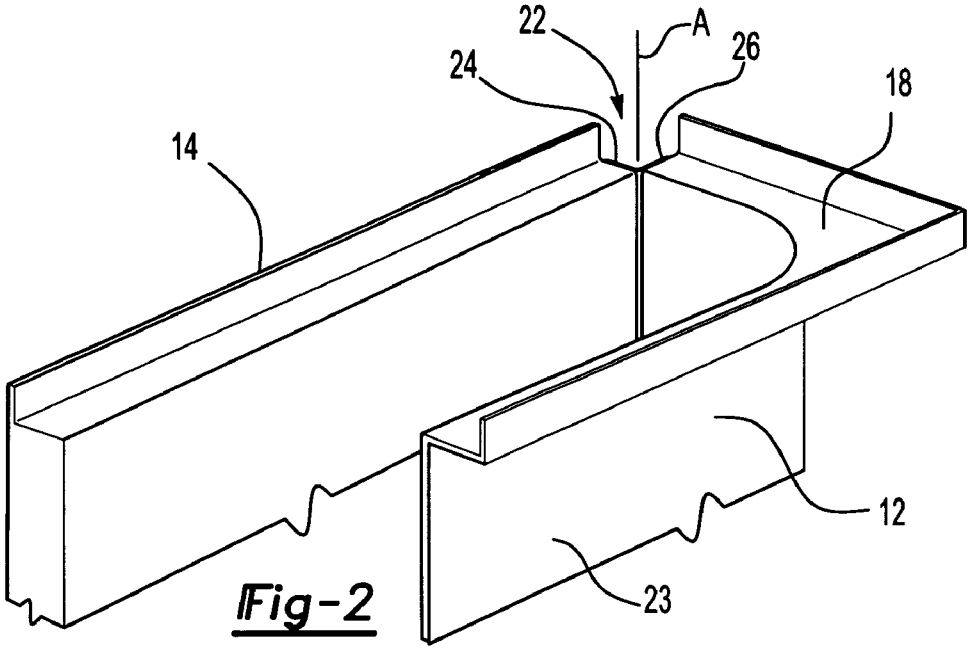
FIG. 2 is a perspective view showing the back wall and one of the side walls in the shipping position.

The first side wall 14 and second side wall 16 are connected to the back wall 12 in a similar manner. For simplicity, only the first side wall 14 and back wall 12 are discussed. Referring to FIG. 2, the first side wall 14 is connected to the back wall 12 by a hinge 22. The hinge 22 allows the first side wall 14 to rotate around an axis A defined by the hinge 22. The first side wall 14 rotates about the axis A relative to the back wall 12. The first side wall 14 is rotated into a position such that the first side wall 14 is generally parallel to a center wall portion 23 of the back wall 12. Although not shown the second side wall 16 would rotate about a similar hinge to also be generally parallel to the center wall portion 23 of the back wall 12. The enclosure 10 is shipped and moved when first side wall 14 and the second side wall 16 are positioned parallel to the center wall portion 23 of the back wall 12.

Figure 3:
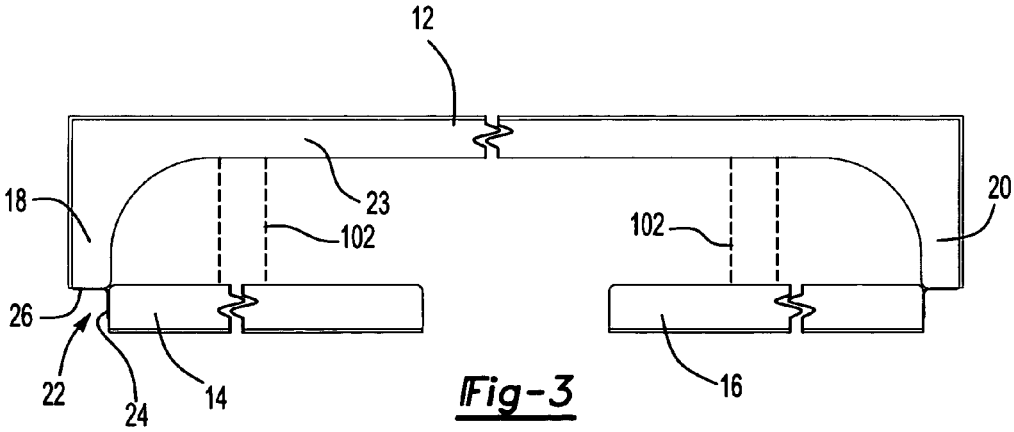
FIG. 3 is a end view of the back wall and one of the side walls in the shipping position.

FIG. 3 shows a perspective view of the first side wall 14 and back wall 12 in the shipping position. As can be appreciated, the three walls can be easily transported, moved to an installation position, and then unfolded for installation. Blocks 102 are shown schematically and may be sued to support the side walls during shipping.

A first portion 24 of the hinge 22 is connected to the first side wall 12. A second portion 26 of the hinge 22 is connected to the back wall 14. The hinge 22 may be connected to the first side wall 14 and back walk 12 by bonding, gluing, fasteners, or the like. One skilled in the art would know be able to select an appropriate means of attachment.

Figure 4:
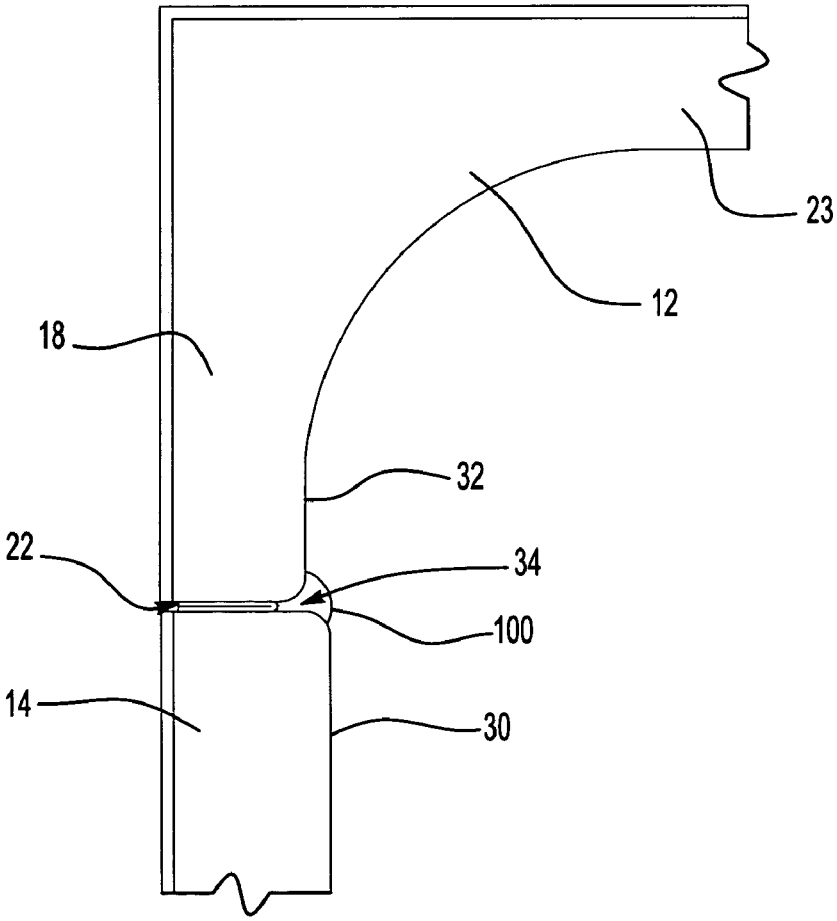
FIG. 4 is an end view of the back wall and one of the side walls in the installation position.

The hinge 22 is disclosed as a living hinge. That is, the hinge 22 is formed from one piece of material. The materially would generally be flexible enough to bend along a center hinge portion 28. The first portion 24 would be along one side of the center hinge portion 28 and the second portion 26 would be on the opposing side of the center hinge portion 28. When the hinge 22 is assembled to the first side wall 14 and the back wall 12 the center hinge portion 28 defines the axis A about which the first side wall 14 rotates. Of course, other type hinges may be utilized FIG. 4 shows an end view of the first side wall 14 and the back wall 12 in an installation position. The interior side 30 of the first side wall 14 extends past the interior side 32 of the back wall 12. The offset between the two walls creates an area 34 where caulk 100 can be applied to seal the joint while obscuring the joint from those looking into the interior of the enclosure 10. That is, the caulk 100 cannot be seen by those looking into the enclosure. In addition, the hinge 22 may run the entire height of the back wall 12 and first side wall 14 acting as a seal between the interior of the enclosure 10 and the sub wall (not shown) behind the enclosure 10.

Figure 5:
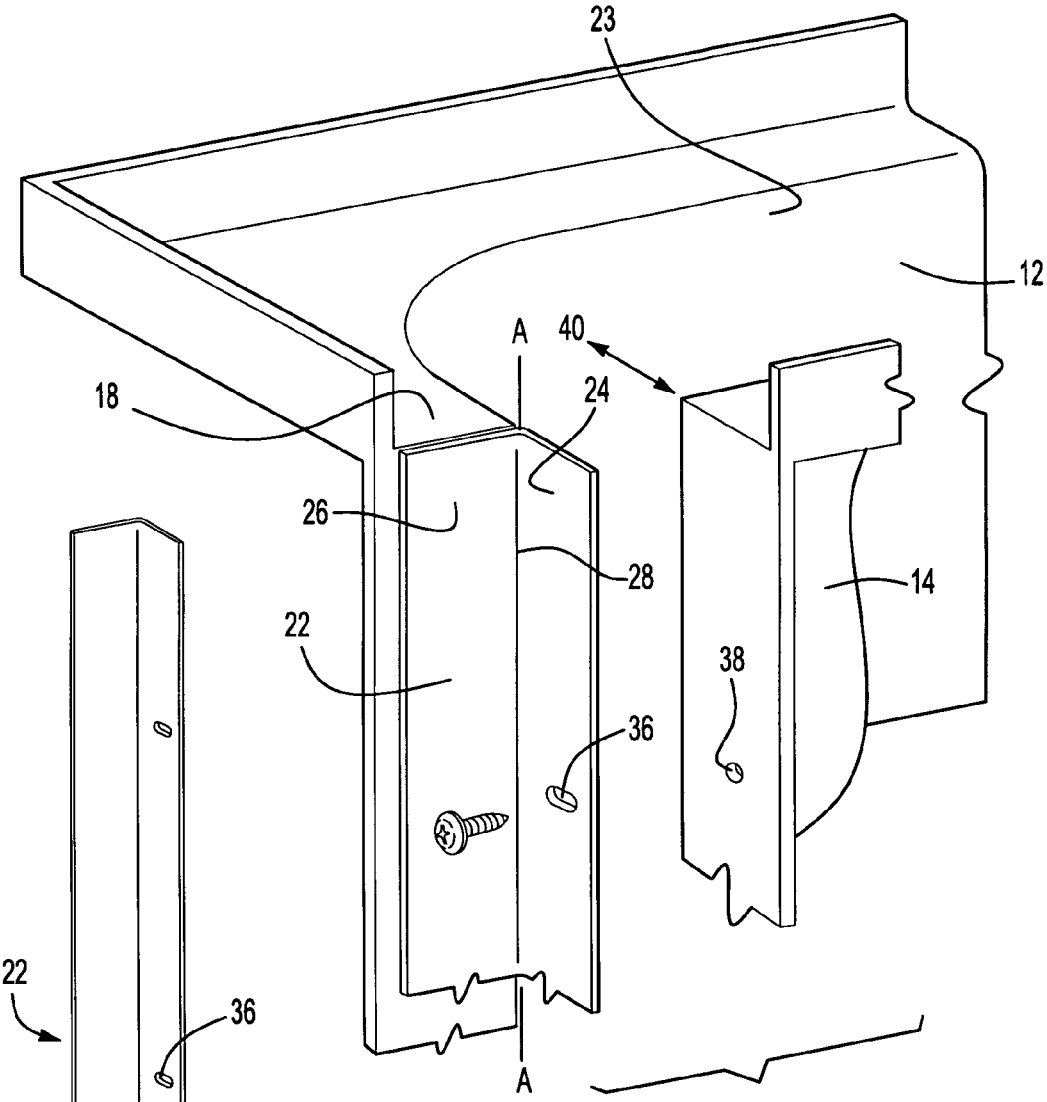
FIG. 5 is a perspective view of one embodiment of the hinge and side wall connection.
Figure 6:
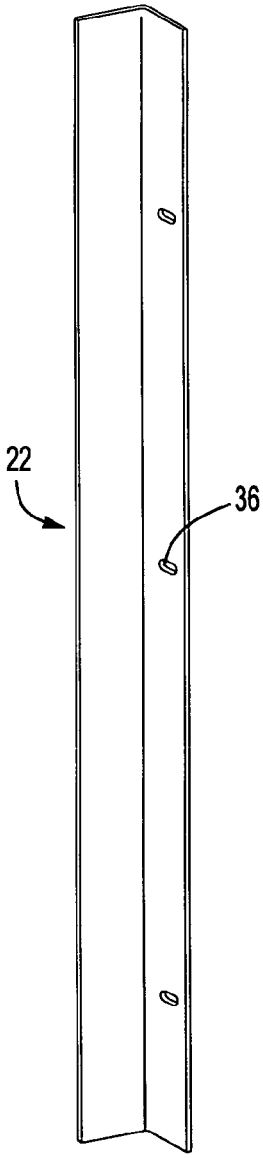
FIG. 6 is a perspective view of one embodiment of the living hinge.

FIG. 5 shows one embodiment of connecting the hinge 22 to the back wall 12 and first side wall 14. The first portion 24 may include a slot 36 and the first side wall 14 have a corresponding hole 38. A screw or other type of fastener may fit through slot 36 in the first portion 24 and into hole 38 in the first side wall 14 to attach the hinge 22 to the first side wall 14. The slot allows for the first side wall 14 to be move inward or outward as indicated by arrow 40 thus allowing alignment between the first side wall 14 and back wall 12 as the enclosure is being assembled. FIG. 6 shows the hinge 22. Several hinges 22 may used for each joint, or a single long hinge, relatively close to the height of the enclosure walls may be used.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A tub enclosure comprising:

a back wall having a first end and a second end opposing said first end;

a first side wall attached to said first end by a first hinge;

a second side wall attached to a second end by a second hinge, said first side wall, said back wall and said second side wall forming a U-shaped enclosure, wherein at least a portion of said back wall is generally parallel to said first side wall and said second side wall when positioned in a U-shape.

2. The tub enclosure of claim 1, wherein said first side wall is rotatable on said first hinge such that said first side wall is generally parallel to another portion of said back wall, and said second side wall is rotatable on said second hinge such that said second side wall is generally parallel to another portion of said back wall.

3. The tub enclosure of claim 2 comprising at least one block that supports at least one of said first side wall and said second side wall relative to said back wall in response to said first side wall and said second side wall being positioned generally parallel to said back wall.

4. The tub enclosure of claim 1, wherein said first hinge and said second hinge are living hinges.

5. The tub enclosure of claim 1, wherein an interior side of said first side wall and said second side wall is offset from an interior side of said back wall, and including a caulk joint formed adjacent the offset in an area between each of said first side wall and said second side wall and said back wall.

6. The tub enclosure of claim 1 wherein said first hinge and said second hinge each include a first portion and a second portion, and at least one of said first portion and said second portion include a slot for receiving a fastener.

7. A tub enclosure comprising:

a back wall having a first portion including a first end and a second end opposing said first end, and second portions extending transversely from said first portion at each of said first end and said second end;

a first side wall attached to one of said second portions of said back wall;

and a second side wall attached to the other of said second portions of said back wall, said first side wall, said back wall and said second side wall forming a U-shaped enclosure, wherein interior sides of said first side wall and second side wall are offset from an interior side of said second portions of said back wall, wherein said interior sides of the said side wall and said second side wall are offset from said interior side of said second portions of said back wall in a direction toward the opposite side wall.

8. The tub enclosure of claim 7 comprising a caulk joint formed adjacent the offset in an area between each of said first side wall and said second side wall and said back wall.

9. The tub enclosure of claim 7 wherein an edge of said first side wall and said second side wall is offset from an edge of said second portions of said back wall.

10. The tub enclosure of claim 7 comprising hinges for connecting said first side wall and said second side wall to said back wall, wherein said hinges each include a first portion and a second portion, and at least one of said first portion and said second portion includes a slot for receiving a fastener.

11. A method of installing a tub enclosure comprising:

a) attaching a first side wall to a first end of a back wall with a hinge and attaching a second side wall to a second end of the back wall with a second hinge;

b) folding the first side wall and the second side wall over the back wall on said hinges;

c) unfolding the first side wall and the second side wall; and d) positioning the first side wall and the second side wall relative to the back wall such that an interior side of the first side wall and the second side wall are offset from an interior side of the back wall.

12. The method of claim 11 wherein said step b) includes rotating the first and second side walls on a living hinges.

13. The method of claim 11 wherein said step c) includes moving the first and second side walls from positions generally parallel to the back wall to positions generally perpendicular to the back wall.

14. The method of claim 11 wherein said step b) includes supporting the first side wall and the second side wall relative to the back wall with a block.

15. The method of claim 11 comprising the step of transporting the tub enclosure subsequent to said step b) and prior to said step c).

16. The method of claim 11 wherein interior sides of the first side wall and the second side wall are offset from an interior side of the back wall in a direction toward the opposite side wall.

* * * * *